US005954542A

United States Patent [19]

Wu et al.

[11] Patent Number: 5,954,542

[45] Date of Patent: Sep. 21, 1999

[54] REAR SHIELDING SHELL FOR A PLUG ELECTRIC CONNECTOR

[75] Inventors: Kun-Tsan Wu; Fu-Chu Wang, both of Tu-Chen, Taiwan

[73] Assignee: Hon Hai Precision Ind. Co., Ltd., Taipei Hsien, Taiwan

[21] Appl. No.: 08/918,560

[22] Filed: Aug. 22, 1997

[30] Foreign Application Priority Data

Sep. 23, 1996 [TW] Taiwan ..... 85214791

[51] Int. Cl.[6] ..... H01R 9/03

[52] U.S. Cl. ..... 439/610; 439/584

[58] Field of Search ..... 439/610, 470, 439/98; 174/135

[56] References Cited

U.S. PATENT DOCUMENTS 1,672,521 6/1928 Goldrick ..... 439/448

4,688,877 8/1987 Dreyer ..... 439/584

5,362,251 11/1994 Bielak ..... 439/584

5,564,942 10/1996 Lee ..... 439/584

*Primary Examiner*—Steven L. Stephan

*Assistant Examiner*—Hae Moon Hyeon

[57] ABSTRACT

A rear shielding shell for a USB plug connector is disclosed. The rear shielding shell defines a main body for connection with a front shielding shell, and a guiding sleeve for an extension of a cable therethrough to connect with contacts mounted to a dielectric body. The guiding sleeve is formed with a retaining portion by applying a cutting operation to the guiding sleeve. The retaining portion can be extended onto the cable extending through the sleeve and fixedly engage therewith and reduce a gap between the cable and the sleeve.

7 Claims, 7 Drawing Sheets

REAR SHIELDING SHELL FOR A PLUG ELECTRIC CONNECTOR

BACKGROUND OF THE INVENTION

1. Field of the Invention

The invention relates to a rear shielding shell for a plug electric connector, particularly to a rear shielding shell for a Universal Serial Bus (USB) plug connector which, in addition to being able to shield contacts and leads of a cable in connection with the contacts, can fix the cable in position.

2. The Prior Art

A variety of types of plug connectors are shown in Taiwan Patent Application Nos. 81205708, 82205124, 83212053, 83215969, 79201839, 80203806, 83212623 and 83214112.

FIG. 1 shows a conventional USB plug connector 500 of the type that the present invention is concerned and intends to improve. The USB plug connector 500 generally consists of a dielectric body 510, a number of contacts 520 mounted to the dielectric body 510, a front shielding shell 525 defining a pair of latching legs 530, a cable 540 having four leads 600 each being clamped by a corresponding contact 520, a spacer 560 for suitably spacing the leads 600 from each other, and a rear shielding shell 570. The rear shielding shell 570 defines a pair of elongated holes 572 (only one being shown). The latching legs 530 are extended through the holes 572 to engage with the rear shielding shell 570 so that the front and rear shielding shells can be connected to entirely shield the leads 600 and the contacts 520, and a guiding sleeve 574 through which the cable 540 can be extended into an inner space defined by the connected front and rear shielding shells 525, 570. After the components as shown in FIG. 1 are assembled, they are subjected to a plastics injection molding process to form a gripping portion (not show) thereon.

The conventional USB plug connector is found to have the disadvantages as set forth below.

First, the guiding sleeve 574 is not formed with a means which can securely engage with the cable 540 to fixedly locate the cable 540 in position. This brings about that the assembling operations for manufacturing the plug connector 500 cannot be carried out smoothly.

Furthermore, since the cable 540 is connected to the connector 500 only by the clamping force of the contacts 520 acting on the leads 600, when a large force is exerted to pull the cable 540 away from the connector 500, a disengagement between the leads 600 and the contacts 520 may occur.

Finally, in order to facilitate the insertion of the cable 540 through the guiding sleeve 574, the guiding sleeve 574 is formed to have a diameter which is sufficiently larger than that of the cable 540. This brings about that a gap is formed between the guiding sleeve 574 and the cable 540, wherein the plastics material for forming the gripping portion (not shown) may flow into the inner space between the front and rear shielding shells 525, 570 via the gap to cause the gripping portion (not shown) to have a thickness less than a predetermined thickness.

Therefore, an objective of the invention is to provide a rear shielding shell for a plug connector, particularly for a USB plug connector. The rear shielding shell has a guiding sleeve for guiding an extension of a cable through the rear shielding shell. The guiding sleeve is formed with a retaining portion whereby the cable can be fixedly located in position.

Another objective of the invention is to provide a rear shielding shell for a plug connector, particularly for a USB plug connector. The rear shielding shell has a guiding sleeve for guiding an extension of a cable through the rear shielding shell. The guiding sleeve is formed with a retaining portion whereby the cable can be securely connected to the connector.

A further objective of the invention is to provide a rear shielding shell for a plug connector, particularly for a USB plug connector. The rear shielding shell has a guiding sleeve for guiding an extension of a cable through the rear shielding shell. The guiding sleeve is formed with a retaining portion whereby plastics material for forming a gripping portion of the plug connector is prevented from flowing into an inner space between the rear shielding shell and a front shielding shell via a gap between the guiding sleeve and the cable.

SUMMARY OF THE INVENTION

According to an aspect of the invention, a rear shielding shell for a USB plug connector includes a main body in connection with a front shielding shell to define an inner space and a guiding sleeve integrally formed with the main body whereby a cable can be extended into the inner space through the guiding sleeve. A retaining portion is formed by the guiding sleeve by applying a cutting operation to the guiding sleeve. The retaining portion can be moved toward the cable to fixedly engage therewith, whereby the cable can be fixedly located in position; a connection between the connector and the cable can be enhanced; and a gap between the cable and the sleeve can be reduced, so that plastics material for forming a gripping portion of the plug connector will not flow into the inner space between the front and rear shielding shells.

DETAILED DESCRIPTION OF THE PREFERRED EMBODIMENTS

Figure 1:
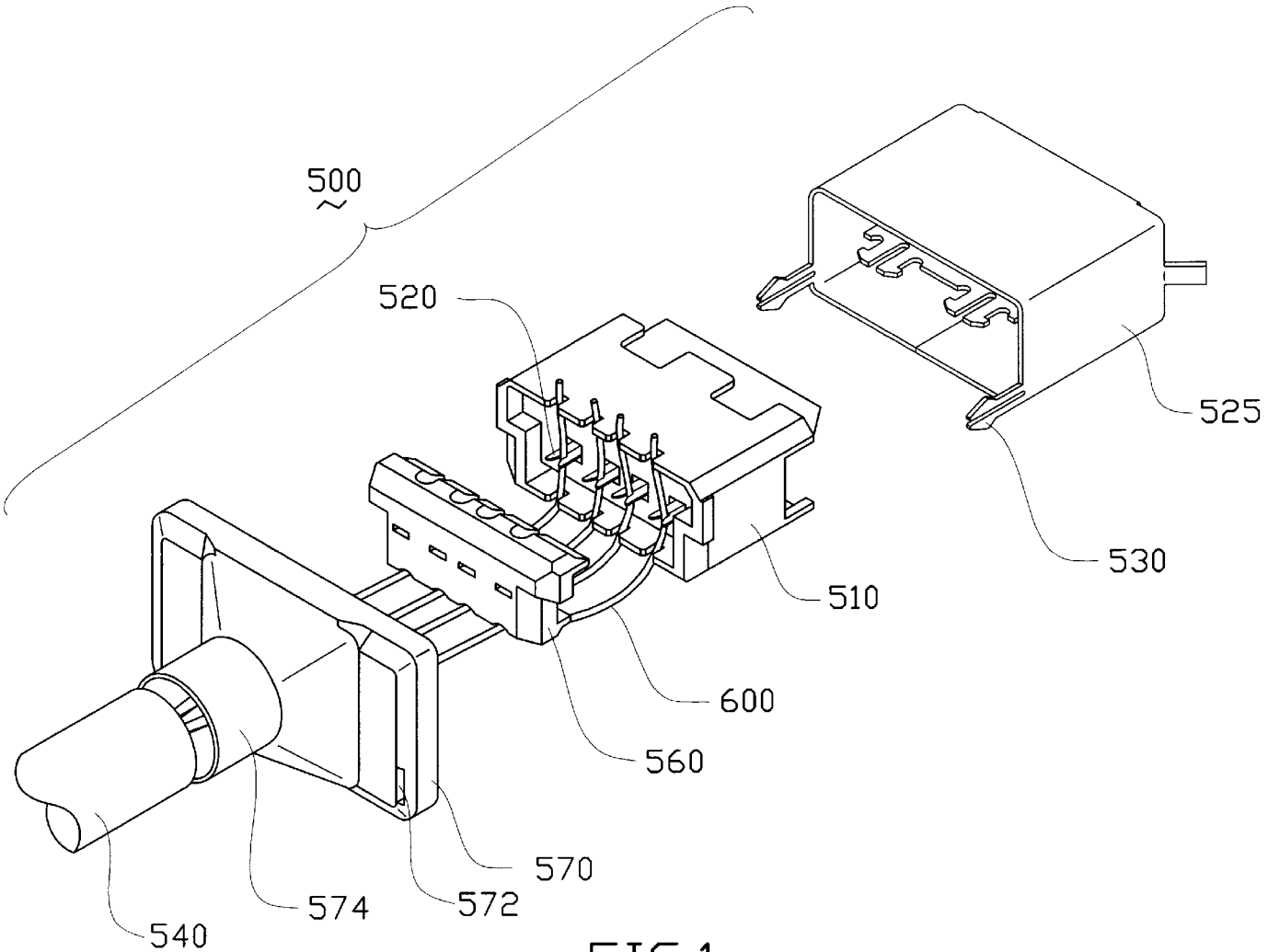
FIG.1 (PRIOR ART)
FIG. 1 is a rear-left-top perspective, exploded view showing the components for constituting a conventional USB plug connector.

References will now be described in detail to the preferred embodiments of the invention. While the present invention has been described in reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments.

Figure 2:
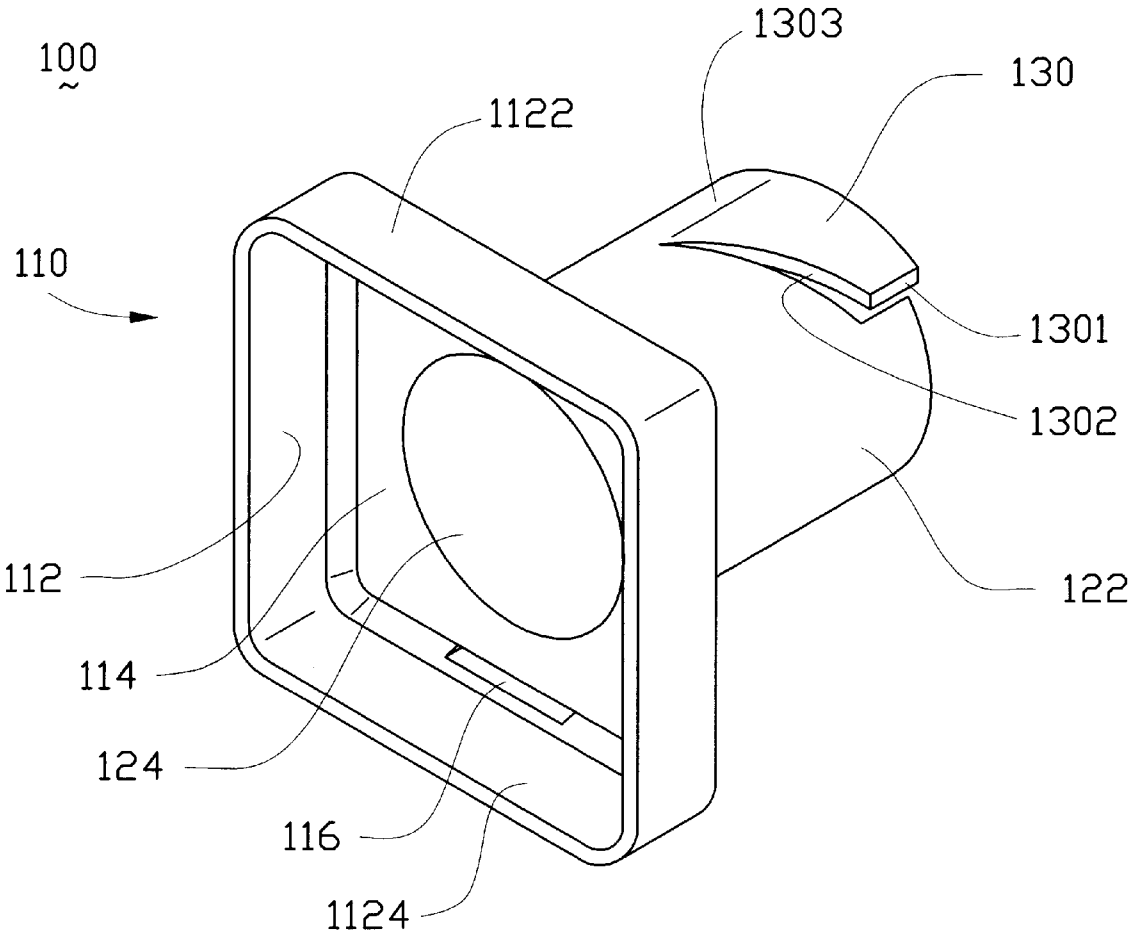
FIG. 2 is a rear-left-top perspective view showing a first embodiment of a rear shielding shell for a USB plug connector in accordance with the present invention.
Figure 3:
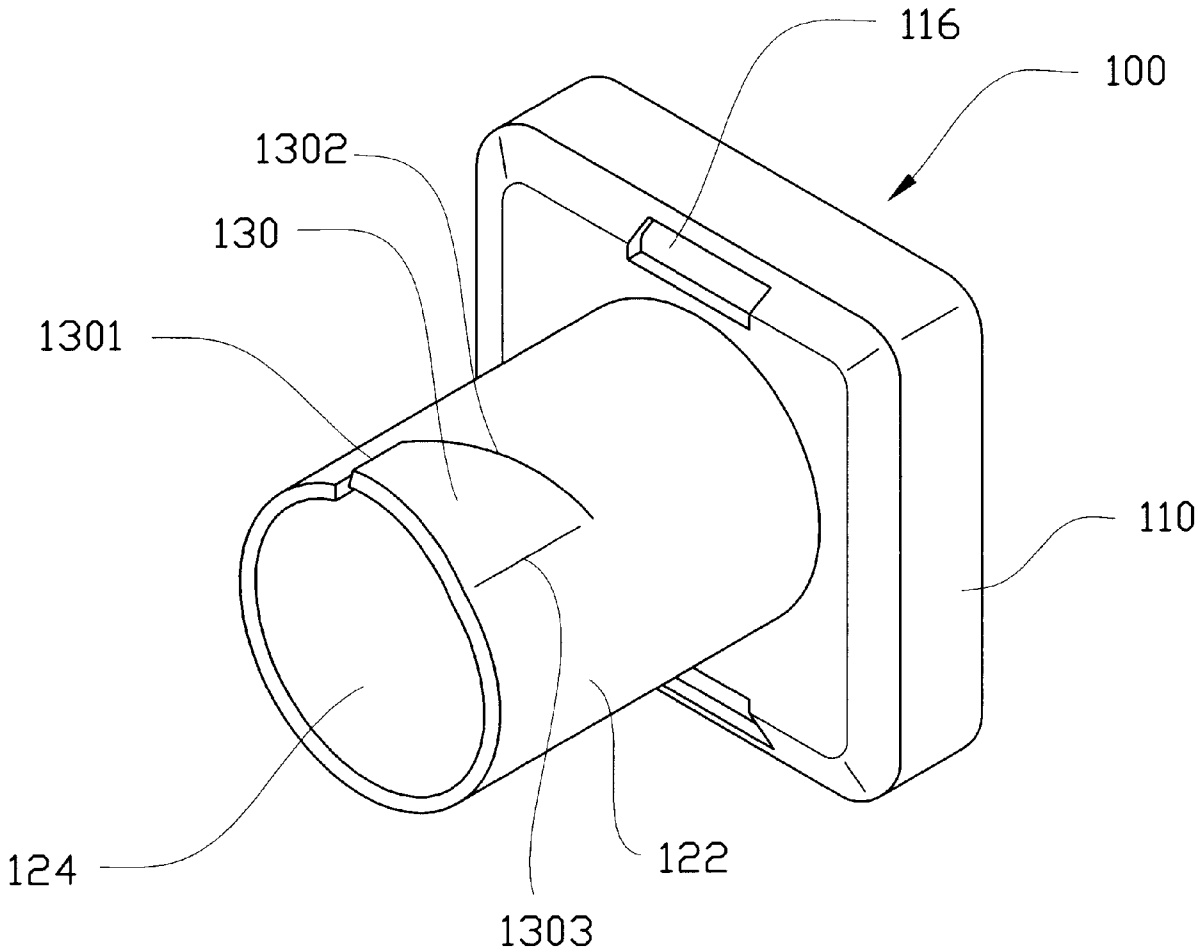
FIG. 3 is a front-right-top perspective view of FIG. 2.

Referring to FIGS. 2 and 3, a rear shielding shell 100 for a USB plug connector in accordance with a first embodiment of the present invention is shown. The rear shielding shell 100 is formed to have a main body 110 consisting of a front plate 114 and a flange 112 extending rearwards from the front plate 114. The flange 112 has a top and bottom wall 1122, 1124. Two elongated holes 116 are formed between the top and bottom walls 1122, 1124 and the front plate 114, respectively. The holes 116 are used for an insertion of latching legs of a front shielding shell (not shown) through the rear shielding shell 110 to engage therewith so that the rear shielding shell and the front shielding shell (not shown) can be connected. A guiding sleeve 122 extends forward from a center of the front plate 114 and defines a central hole 124. A retaining portion 130 in the form of a tab is formed at a front end portion of the guiding sleeve 122. The tab 130 is formed by cutting the guiding sleeve 122 to have an axially extending edge 1301 and a generally circumferentially extending edge 1302, and a bend 1303 generally axially extending from a front end of the guiding sleeve 122 to a root of the circumferentially extending edge 1302.

Figure 4A:
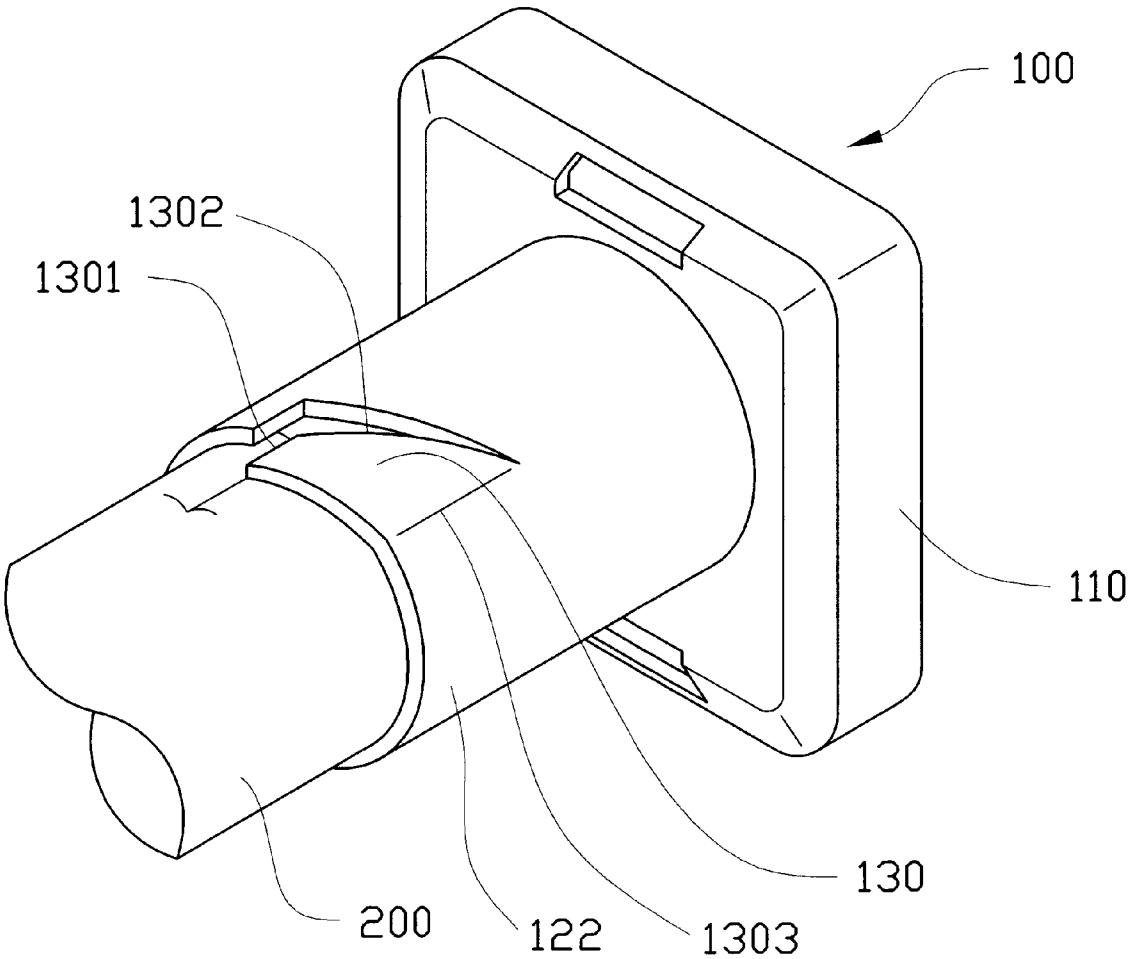
FIG. 4(A) is a front-right-top perspective view showing that the rear shielding shell of FIG. 3 is connected with a cable.

Also referring to FIG. 4(A), in the present invention, when a cable 200 is extended through the guiding sleeve 122 with a predetermined length, the retaining portion 130 is subjected to a bending operation to cause the axially extending edge 1301 to extend onto the cable 200 to fixedly connect with the cable 200. By this arrangement, the cable 200 is fixedly connected to the rear shielding shell 100; thus, the cable 200 can be fixed in position to facilitate the following assembling of the plug connector. Furthermore, the cable 200 is connected to the connector not only by the clamping force of contacts (not shown) acting on leads (not shown) of th e cable 200, but also by the engaging force of the retaining portion 130 acting on the cable 200; thus, the cable 200 can be very securely connected to the connector. Finally, the bending of the retaining portion 130 toward the cable 200 causes a gap between the guiding sleeve 122 and the cable 200 to be reduced. Thus, during a later plastics injection molding process for forming a gripping portion, plastics material will not flow into a space defined between the front shielding shell (not shown) and the rear shielding shell 100, whereby a thickness of a gripping portion formed by the molding process can always be assured to have a predetermined thickness.

Figure 4B:
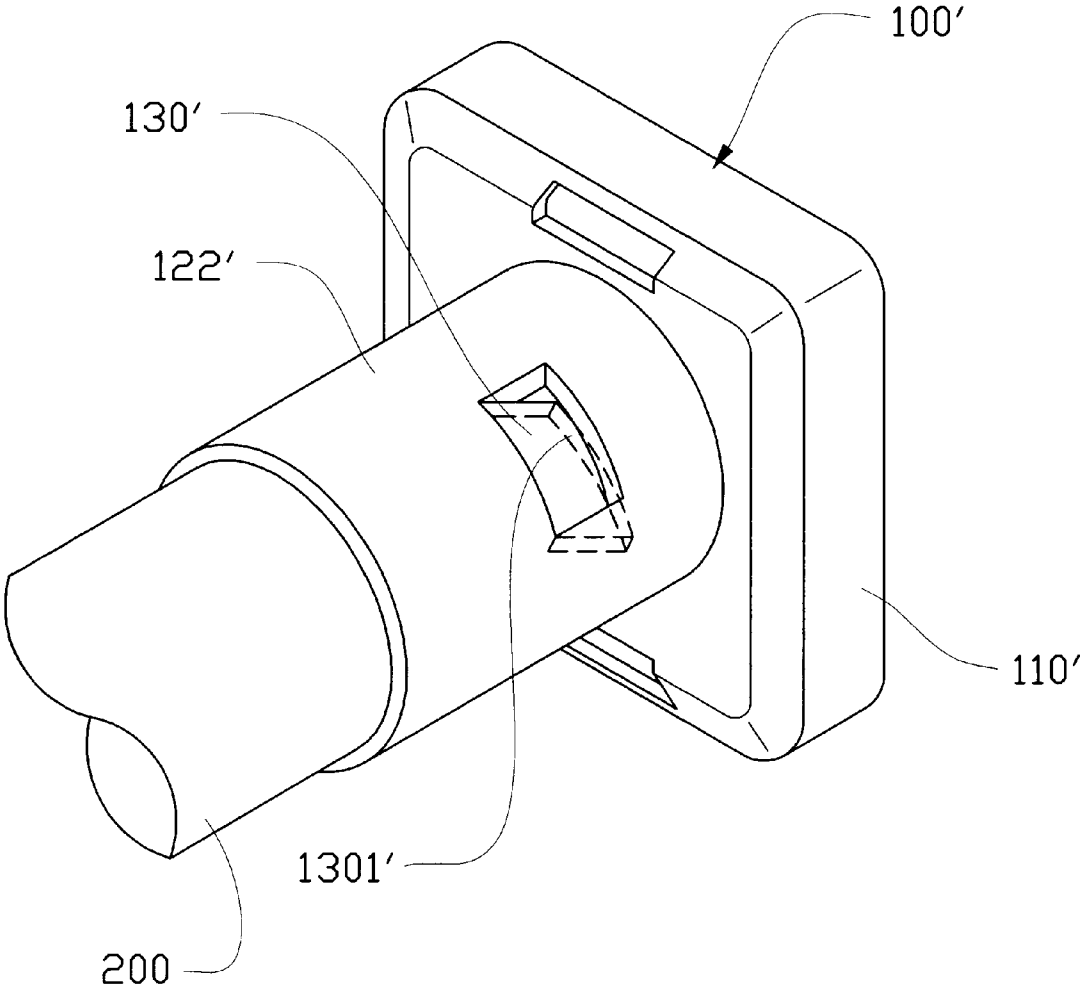
FIG. 4(B) is a view similar to FIG. 4(A), but shows that a rear shielding shell in accordance with a second embodiment of the present invention is connected with a cable.

FIG. 4(B) shows a rear shielding shell 100' in accordance with a second embodiment of the present invention. The rear shielding shell 100' is connected with a cable 200. In the second embodiment, a retaining portion 130' is formed as a cantilever tab in a middle portion of a guiding sleeve 122' and has a rectangular shape. The rectangular retaining portion 130' has a distal edge 1301' facing a main body 110' of t he rear shielding shell 100'. In this embodiment, after the cable 200 is inserted through the guiding sleeve 122', the rectangular retaining portion 130' is bent toward the cable 200 to cause the distal edge 1301' thereof to extend onto the cable 200 and engage therewith. In addition to the advantages in respective to the first embodiment, the second embodiment has a further advantage that when a pulling force is exerted to the cable 200 to cause it to leave the connector, the pulling force will cause the retaining portion 130' to be further bent onto the cable 200. Thus, a secure connection between the cable 200 and the connector can be ensured.

Figure 4C:
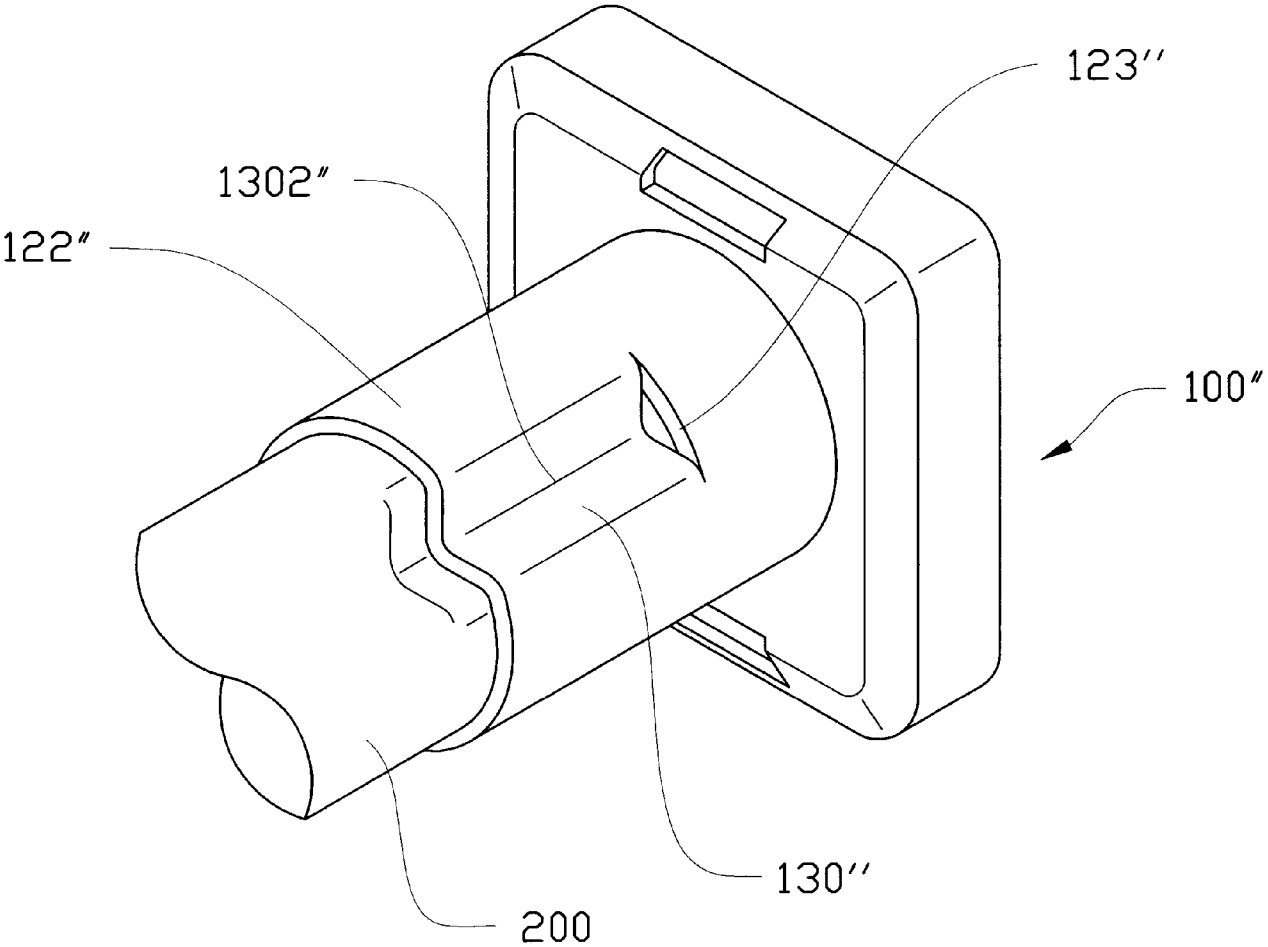
FIG. 4(C) is a view similar to FIG. 4(A), but shows that a rear shielding shell in accordance with a third embodiment of the present invention is connected with a cable.

FIG. 4(C) shows a rear shielding shell 100" for a USB plug connector in accordance with a third embodiment of the present invention, wherein the rear shielding shell 100" is connected with a cable 200. In the third embodiment, the rear shielding shell 100" is formed with a slit 123" circumferentially extending along a middle portion of a guiding sleeve 122" thereof. A retaining portion 130" in the third embodiment is formed by a portion of the guiding sleeve 122" in front of the slit 123". After the cable 200 is inserted into the guiding sleeve 122", a bending and forming operation is applied to the retaining portion 130" to cause a middle part 1302" thereof to extend onto the cable 200 and engage therewith as shown by FIG. 4(C), whereby the advantages obtainable by the first embodiment are also obtainable by this embodiment.

Figure 5:
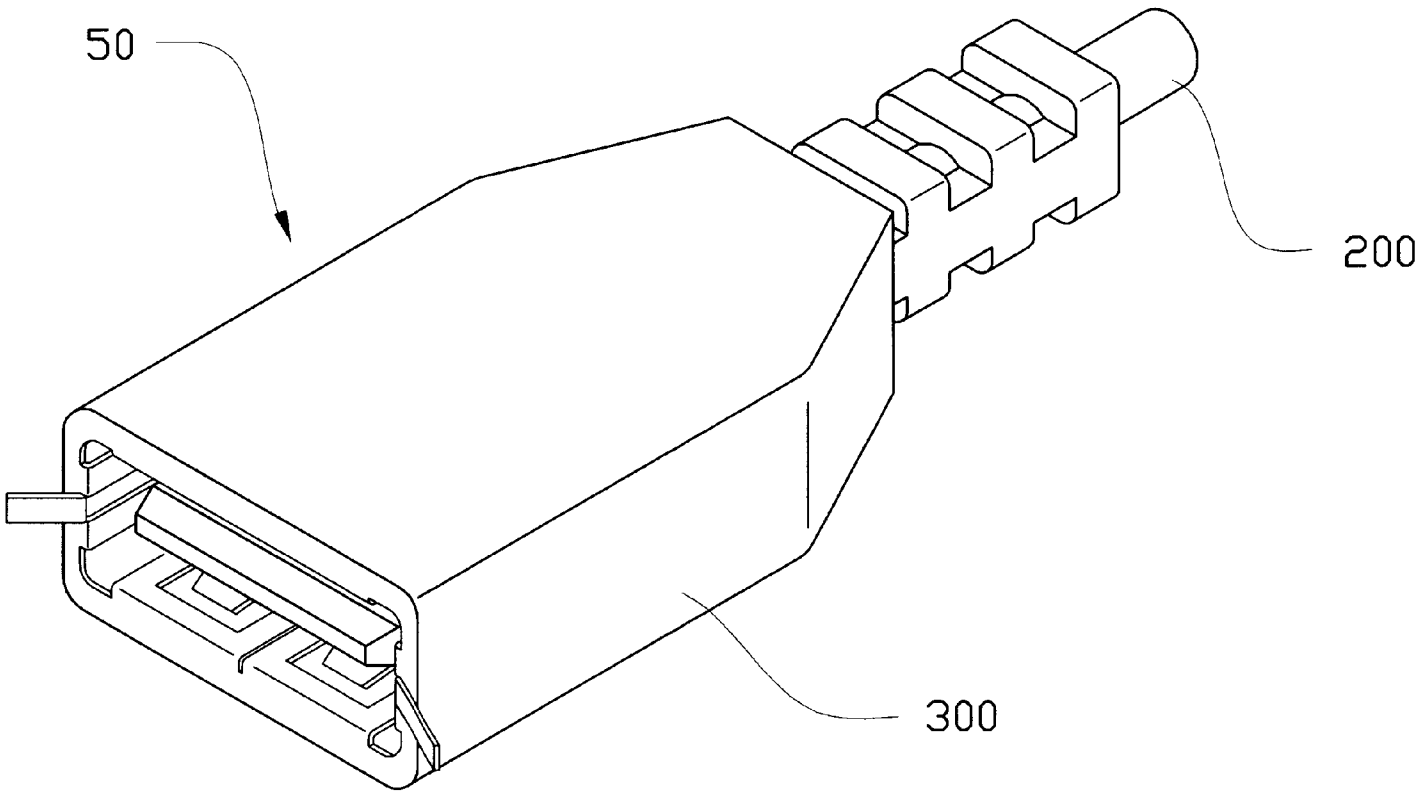
FIG. 5 is a view showing a USB plug connector incorporating a rear shielding shell in accordance with the present invention.

FIG. 5 shows a USB plug connector 50 incorporating a rear shielding shell in accordance with the present invention, wherein a gripping portion 300 thereof has a thickness meeting a predetermined thickness, since plastics material for forming the gripping portion 300 is prevented from flowing into a space defined between a front shielding shell (not shown) and the rear shielding shell (not shown) via a gap between a cable 200 and a guiding sleeve of the rear shielding shell (not shown).

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field shall understand that all such equivalent structures are to be included within the scope of the following claims.

We claim:

1. A rear shielding shell for an electric connector, comprising:

a main body for connection with a front shielding shell; and a guiding sleeve connected with the main body for guiding an extension of a cable through the rear shielding shell, said guiding sleeve defining a retaining portion by cutting the sleeve and a front end distant from the main body, wherein said retaining portion can be moved toward a hole defined by the sleeve to engage with the cable extending therethrough;

wherein the retaining portion is formed to have a first edge extending from the front end toward a middle portion of the guiding sleeve and a second edge connecting with the first edge, the first edge being substantially axially extended and the second edge being substantially circumferentially extended.

2. The rear shielding shell in accordance with claim 1, wherein the retaining portion further comprises a bend extending from the front end of the sleeve toward an end of the second edge distant from the first edge.

3. A combination of a shielding shell and a cable, said shielding shell comprising a sleeve, said cable extending through the sleeve, said sleeve being formed with a retaining portion by applying a cutting operation to the sleeve, said retaining portion being extended onto the cable and fixedly engaging therewith, wherein said retaining portion is formed to have a first edge substantially axially extending from an end of the sleeve toward a middle portion thereof and a second edge substantially circumferentially extending from the first edge, said retaining portion being bent toward the cable to reach a position at which the first edge extends to the cable and fixedly engages therewith.

4. An electric connector, comprising:

a body;

a number of contacts mounted to the body;

a shielding device magnetically shielding the contacts;

a guiding sleeve fixed to the shielding device and defining a retaining portion by applying a cutting operation to the guiding sleeve to have a first edge substantially axially extending from a free end of the sleeve toward a middle portion thereof and a second edge substantially circumferentially extending from the first edge; and a cable with an end extended through the guiding sleeve to enter the shielding device and electrically and mechanically connect with the contacts, wherein the cable is fixedly connected to the guiding sleeve by extending the retaining portion onto the cable to fixedly engage therewith.

5. The electric connector in accordance with claim 4, wherein the shielding device comprises a front and rear shielding shell, the front shielding shell defining a latching leg, the rear shielding shell connected with the guiding sleeve and defining a hole, the latching leg being extended through the hole to engage with the rear shielding shell to securely connect the front and rear shielding shells.

6. A rear shielding shell for an electrical connector, comprising:

a main body for connection with a front shielding shell; and a guiding sleeve connected with the main body for guiding an extension of a cable through the rear shielding shell, said guiding sleeve defining a retaining portion by cutting the sleeve and a front end distant from the main body, wherein said retaining portion can be moved toward a hole defined by the sleeve to engage with the cable extending therethrough, the guiding sleeve defining a slit substantially circumferentially therealong, and the retaining portion being defined by a portion of the guiding sleeve in front of the slit.

7. A combination of a shielding shell and a cable, said shielding shell comprising a sleeve, said cable extending through the sleeve, said sleeve being formed with a retaining portion by applying a cutting operation on the sleeve, said retaining portion being extended onto the cable and fixedly engaging therewith, wherein the sleeve defines a slit substantially circumferentially therealong, and the retaining portion is defined by a portion of the sleeve extending from the slit toward an end of the sleeve, said retaining portion having a middle part extending to the cable and fixedly engaging therewith.

* * * * *